US010373489B2

(12) United States Patent
Malkes et al.

(10) Patent No.: US 10,373,489 B2
(45) Date of Patent: Aug. 6, 2019

(54) SYSTEM AND METHOD OF ADAPTIVE CONTROLLING OF TRAFFIC USING CAMERA DATA

(71) Applicant: Cubic Corporation, San Diego, CA (US)

(72) Inventors: William A. Malkes, Knoxville, TN (US); William S. Overstreet, Knoxville, TN (US); Jeffery R. Price, Knoxville, TN (US); Michael J. Tourville, Lenoir City, TN (US)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 16/030,396

(22) Filed: Jul. 9, 2018

(65) Prior Publication Data

US 2019/0051160 A1 Feb. 14, 2019

Related U.S. Application Data

(60) Provisional application No. 62/544,499, filed on Aug. 11, 2017.

(51) Int. Cl.
*G08G 1/01* (2006.01)
*G08G 1/04* (2006.01)
(Continued)

(52) U.S. Cl.
CPC ..... *G08G 1/0145* (2013.01); *G08G 1/0116* (2013.01); *G08G 1/0133* (2013.01);
(Continued)

(58) Field of Classification Search
CPC .... G08G 1/0145; G08G 1/0133; G08G 1/081; G08G 1/0141; G08G 1/01; G08G 1/0965; G08G 1/04; G08G 1/08
See application file for complete search history.

(56) References Cited

U.S. PATENT DOCUMENTS 4,833,469 A 5/1989 David
5,111,401 A 5/1992 Everett et al.
(Continued)

FOREIGN PATENT DOCUMENTS

CN 100533151 8/2009
CN 101799987 8/2010
(Continued)

OTHER PUBLICATIONS

Dehghan et al., Afshin; "Automatic Detection and Tracking of Pedestrians in Videos with Various Crowd Densities", Pedestrian and Evacuation Dynamics 2012.
(Continued)

*Primary Examiner* — Munear T Akki
(74) *Attorney, Agent, or Firm* — Kilpatrick Townsend & Stockton, LLP

(57) ABSTRACT

A system and a method for adaptively controlling of traffic are disclosed. The method includes receiving traffic data from one or more sensors at the intersection; detecting at least one pattern in the traffic data for a given period of time; identifying at least one variable in the pattern; determining if the at least one variable is associated with one or more available traffic patterns at the intersection; based on the determining, retrieving a current traffic control program implemented at the intersection; adaptively controlling the traffic at the intersection during the given period of time by adjusting one or more parameters of the current traffic control program to yield a modified traffic control program; and storing the modified traffic control program in a database for future use.

17 Claims, 5 Drawing Sheets

(51) Int. Cl.
*G08G 1/08* (2006.01)
*G08G 1/081* (2006.01)

(52) U.S. Cl.
CPC ..... *G08G 1/04* (2013.01); *G08G 1/08* (2013.01); *G08G 1/081* (2013.01)

(56) References Cited

U.S. PATENT DOCUMENTS

| | | | | |
|---|---|---|---|---|
| 5,208,584 | A * | 5/1993 | Kaye | G08G 1/07 340/478 |
| 5,406,490 | A | 4/1995 | Braegas | |
| 5,444,442 | A | 8/1995 | Sadakata et al. | |
| 6,064,139 | A | 5/2000 | Ozawa et al. | |
| 6,075,874 | A | 6/2000 | Higashikubo et al. | |
| 6,317,058 | B1 | 11/2001 | Lemelson et al. | |
| 6,366,219 | B1 * | 4/2002 | Hoummady | G08G 1/04 340/907 |
| 6,405,132 | B1 | 6/2002 | Breed et al. | |
| 6,505,046 | B1 | 1/2003 | Baker | |
| 6,526,352 | B1 | 2/2003 | Breed et al. | |
| 6,720,920 | B2 | 4/2004 | Breed et al. | |
| 6,741,926 | B1 | 5/2004 | Zhao et al. | |
| 6,751,552 | B1 | 6/2004 | Minelli | |
| 6,768,944 | B2 | 7/2004 | Breed et al. | |
| 6,862,524 | B1 | 3/2005 | Nagda et al. | |
| 6,937,161 | B2 * | 8/2005 | Nishimura | G08G 1/08 340/916 |
| 7,110,880 | B2 | 9/2006 | Breed et al. | |
| 7,610,146 | B2 | 10/2009 | Breed | |
| 7,630,806 | B2 | 12/2009 | Breed | |
| 7,698,055 | B2 | 4/2010 | Horvitz et al. | |
| 7,698,062 | B1 | 4/2010 | McMullen et al. | |
| 7,821,421 | B2 | 10/2010 | Tamir et al. | |
| 7,835,859 | B2 | 11/2010 | Bill | |
| 7,899,611 | B2 | 3/2011 | Downs et al. | |
| 7,979,172 | B2 | 7/2011 | Breed | |
| 8,050,863 | B2 | 11/2011 | Trepagnier et al. | |
| 8,135,505 | B2 | 3/2012 | Vengroff et al. | |
| 8,144,947 | B2 | 3/2012 | Kletter | |
| 8,212,688 | B2 * | 7/2012 | Morioka | G08G 1/08 340/907 |
| 8,255,144 | B2 | 8/2012 | Breed et al. | |
| 8,373,582 | B2 | 2/2013 | Hoffberg | |
| 8,566,029 | B1 | 10/2013 | Lopatenko et al. | |
| 8,589,069 | B1 | 11/2013 | Lehman | |
| 8,682,812 | B1 | 3/2014 | Ran | |
| 8,706,394 | B2 | 4/2014 | Trepagnier et al. | |
| 8,825,350 | B1 | 9/2014 | Robinson | |
| 8,903,128 | B2 | 12/2014 | Shet et al. | |
| 9,043,143 | B2 | 5/2015 | Han | |
| 9,387,928 | B1 | 7/2016 | Gentry et al. | |
| 9,965,951 | B1 * | 5/2018 | Gallagher | G08G 1/0145 |
| 2004/0155811 | A1 | 8/2004 | Albero et al. | |
| 2005/0187708 | A1 * | 8/2005 | Joe | G08G 1/092 701/431 |
| 2007/0162372 | A1 | 7/2007 | Anas | |
| 2007/0208494 | A1 * | 9/2007 | Chapman | G08G 1/0104 701/117 |
| 2007/0273552 | A1 * | 11/2007 | Tischer | G08G 1/01 340/910 |
| 2008/0094250 | A1 | 4/2008 | Myr | |
| 2008/0195257 | A1 | 8/2008 | Rauch | |
| 2009/0048750 | A1 | 2/2009 | Breed | |
| 2009/0051568 | A1 * | 2/2009 | Corry | G08G 1/081 340/935 |
| 2011/0037618 | A1 | 2/2011 | Ginsberg et al. | |
| 2011/0205086 | A1 | 8/2011 | Lamprecht et al. | |
| 2012/0038490 | A1 * | 2/2012 | Verfuerth | H05B 37/0272 340/910 |
| 2012/0112928 | A1 * | 5/2012 | Nishimura | G08G 1/07 340/909 |
| 2014/0136414 | A1 | 5/2014 | Abhyanker | |
| 2014/0277986 | A1 | 9/2014 | Mahler et al. | |
| 2017/0169309 | A1 | 6/2017 | Reddy et al. | |
| 2018/0075739 | A1 | 3/2018 | Ginsberg et al. | |
| 2019/0049264 | A1 | 2/2019 | Malkes | |
| 2019/0050647 | A1 | 2/2019 | Malkes | |
| 2019/0051152 | A1 | 2/2019 | Malkes | |
| 2019/0051161 | A1 | 2/2019 | Malkes | |
| 2019/0051162 | A1 | 2/2019 | Malkes | |
| 2019/0051163 | A1 | 2/2019 | Malkes | |
| 2019/0051164 | A1 | 2/2019 | Malkes | |
| 2019/0051167 | A1 | 2/2019 | Malkes | |
| 2019/0051171 | A1 | 2/2019 | Malkes | |

FOREIGN PATENT DOCUMENTS

| | | |
|---|---|---|
| CN | 101944295 | 1/2011 |
| EP | 0 464 821 | 1/1992 |
| KR | 2013-0067847 | 6/2013 |

OTHER PUBLICATIONS

Dubska et al.; "Automatic Camera Calibration for Traffic Understanding", bmva.org, 2014.
Grosser, Kari; "Smart lo T Technologies for Adaptive Traffic Management Using a Wireless Mes Sensor Network", Advantech Industrial lo T Blog, Feb. 3, 2017.
https://www.flir.com, 2018.
Halper, Mark; Smart Cameras Will Help Spokane Light It's World More Intelligently (Updated), LEDs Magazine, and Business/Energy/Technology Journalist, Apr. 19, 2017.
Heaton, Brian; "Smart Traffic Signals Get a Green Light", Government Technology Magazine, Feb. 15, 2012.
Kolodny, Lora; Luminar reveals sensors that could make self-driving cars safer than human, Techcrunch, Apr. 13, 2017.
McDermott, John; "Google's newest secret weaon for local ads", Digiday, Jan. 29, 2014.
Resnick, Jim; "How Smart Traffic Signals May Ease Your Commute", BBC, Autos, Mar. 18, 2015.
Sun et al., M.; "Relating Things and Stuff Via Object Property Interactions", cvgl.stanford.edu, Sep. 4, 2012.
Whitwam, Ryan; "How Google's self-driving cars detect and avoid obstacles", ExtremeTech, Sep. 8, 2014.
Yamaguchi, Jun'ichi; "Three Dimensional Measurement Using Fisheye Stereo Vision", Advances in Theory and Applications of Stereo Vision, Dr. Asim Bhatti (Ed.), ISBN:978-953-307-516-7, InTech. Jan. 8, 2011.
U.S. Appl. No. 16/044,891, William A. Malkes, System and Method for Controlling Vehicular Traffic, filed Jul. 25, 2018.
U.S. Appl. No. 16/032,886, William A. Malkes, Adaptive Traffic Control Using Object Tracking and Identity Details, filed Jul. 11, 2018.
U.S. Appl. No. 16/058,106, William A. Malkes, System and Method for Managing Traffic by Providing Recommendations to Connected Objects, filed Aug. 8, 2018.
U.S. Appl. No. 16/059,814, William A. Malkes, System and Method of Navigation Vehicles, dated Aug. 9, 2018.
U.S. Appl. No. 16/059,886, William A. Malkes, Systems and Methods of Adaptive Traffic Optimization Using Unmanned Aerial Vehicles, filed Aug. 9, 2018.
U.S. Appl. No. 16/058,214, William A. Malkes, System and Method of Adaptive Traffic Management, filed Aug. 8, 2018.
U.S. Appl. No. 16/100,750, William A. Malkes, System and Method of Adaptive Traffic Management at an Intersection, filed Aug. 10, 2018.
U.S. Appl. No. 16/101,766, William A. Malkes, System and Method for Retail Revenue Based Traffic Management, filed Aug. 10, 2018.
U.S. Appl. No. 16/101,933, William A. Malkes, Adaptive Optimization of Navigational Routes Using Traffic Data, filed Aug. 13, 2018.
U.S. Appl. No. 16/058,343, William A. Malkes, System and Method of Adaptive Controlling of Traffic Using Zone Based Occupancy, filed Aug. 8, 2018.
U.S. Appl. No. 16/058,343, Office Action dated Nov. 19, 2018.

* cited by examiner

SYSTEM AND METHOD OF ADAPTIVE CONTROLLING OF TRAFFIC USING CAMERA DATA

CROSS-REFERENCE TO RELATED APPLICATIONS

This application claims priority to U.S. Provisional Patent Application No. 62/544,499 filed on Aug. 11, 2017, the entire content of which is incorporated herein by reference.

FIELD OF THE DISCLOSURE

The present disclosure is generally related to traffic control systems, and more particularly related to adaptive controlling of traffic using sensor data.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also correspond to implementations of the claimed technology.

Traffic control systems regulate the flow of traffic through intersections. Generally, traffic signals, comprising different color and/or shapes of lights, are mounted on poles or span wires at the intersection. These traffic signals are used to regulate the movement of traffic through the intersection by turning on and off their different signal lights. These signals, together with the equipment that turns on and off their different lights, comprise a traffic control system. In cities, the amount of traffic is vast and thus movement in multiple directions is allowed for fast discharge of vehicles to prevent traffic congestion. Despite providing such mechanisms, traffic control systems fail to avoid traffic congestion, particularly during the peak hours and during inclement weather.

Remote traffic control systems are also present in the art, where an operator remotely controls the traffic signals. The operator controls the signals based on the number of vehicles present on each road. The operator determines the number of vehicles from a video feed provided by a surveillance camera mounted on the traffic signal indicator. Further, such manual operation to control the traffic fails too, as inappropriate distribution of movement time (a few seconds) on any road aggravates the traffic condition.

Thus, the current state of art merely involves usage of traffic data and lacks an efficient mechanism to adaptively regulate the traffic flow in different conditions.

SUMMARY

One or more example embodiments of inventive concepts are directed to providing adaptive traffic control mechanisms at an intersection (or a group of intersections in vicinity of each other) based on analysis of real time conditions/variables as well as historic conditions/variables and associated trends.

One aspect of the present disclosure includes a method of adaptively controlling traffic at an intersection. The method includes receiving traffic data from one or more sensors at the intersection; detecting at least one pattern in the traffic data for a given period of time; identifying at least one variable in the pattern; determining if the at least one variable is associated with one or more available traffic patterns at the intersection; based on the determining, retrieving a current traffic control program implemented at the intersection; adaptively controlling the traffic at the intersection during the given period of time by adjusting one or more parameters of the current traffic control program to yield a modified traffic control program; and storing the modified traffic control program in a database for future use.

One aspect of the present disclosure includes a traffic controller having memory with computer-readable instructions stored therein and one or more processors configured to execute the computer-readable instructions to receive traffic data from one or more sensors at the intersection; detect at least one pattern in the traffic data for a given period of time; identify at least one variable in the pattern; determine if the at least one variable is associated with one or more available traffic patterns at the intersection; based on the determining, retrieve a current traffic control program implemented at the intersection; adaptively control the traffic at the intersection during the given period of time by adjusting one or more parameters of the current traffic control program to yield a modified traffic control program; and store the modified traffic control program in a database for future use.

One aspect of the present disclosure includes one or more non-transitory computer-readable medium having computer-readable instructions stored thereon, which when executed by one or more processors, cause the one or more processors to: receive traffic data from one or more sensors at the intersection; detect at least one pattern in the traffic data for a given period of time; identify at least one variable in the pattern; determine if the at least one variable is associated with one or more available traffic patterns at the intersection; based on the determining, retrieve a current traffic control program implemented at the intersection; adaptively control the traffic at the intersection during the given period of time by adjusting one or more parameters of the current traffic control program to yield a modified traffic control program; and store the modified traffic control program in a database for future use.

BRIEF DESCRIPTION OF THE DRAWINGS

The accompanying drawings illustrate various example embodiments of systems, methods, and example embodiments of various other aspects of the disclosure. Any person with ordinary skills in the art will appreciate that the illustrated element boundaries (e.g. boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles.

DETAILED DESCRIPTION

Figure 1:
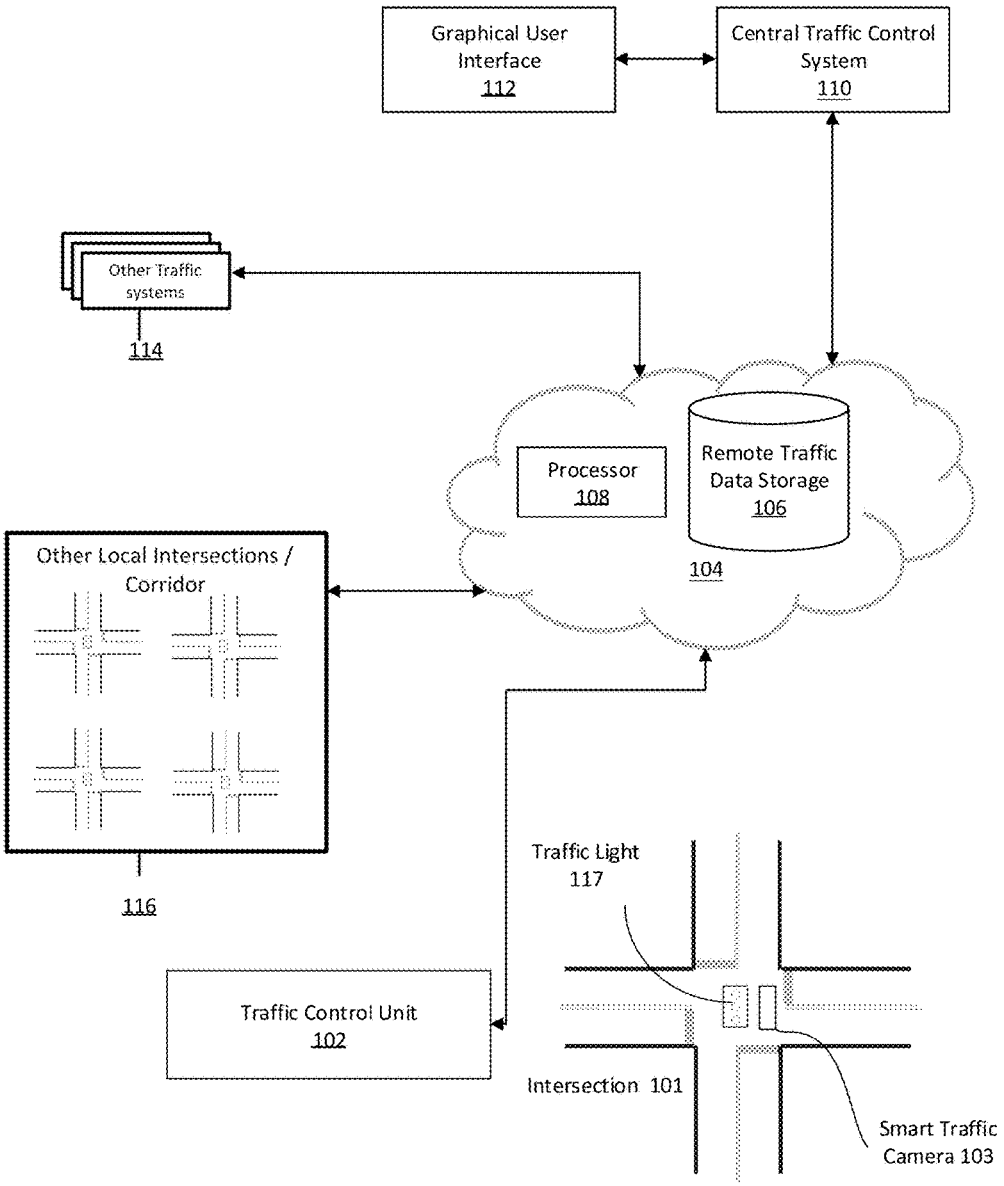
FIG. 1 illustrates a system for adaptive controlling of traffic, according to an example embodiment.

Some example embodiments of this disclosure, illustrating all its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context dearly dictates otherwise. Although any systems and methods similar or equivalent to those described herein can be used in the practice or testing of example embodiments of the present disclosure, the preferred, systems and methods are now described.

Although the terms first, second, etc. may be used herein to describe various elements, these elements should not be limited by these terms. These terms are only used to distinguish one element from another. For example, a first element could be termed a second element, and similarly, a second element could be termed a first element, without departing from the scope of this disclosure. As used herein, the term "and/or," includes any and all combinations of one or more of the associated listed items.

When an element is referred to as being "connected," or "coupled," to another element, it can be directly connected or coupled to the other element or intervening elements may be present. By contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Specific details are provided in the following description to provide a thorough understanding of embodiments. However, it will be understood by one of ordinary skill in the art that embodiments may be practiced without these specific details. For example, systems may be shown in block diagrams so as not to obscure the embodiments in unnecessary detail. In other instances, well-known processes, structures and techniques may be shown without unnecessary detail in order to avoid obscuring embodiments.

Although a flow chart may describe the operations as a sequential process, many of the operations may be performed in parallel, concurrently or simultaneously. In addition, the order of the operations may be re-arranged. A process may be terminated when its operations are completed, but may also have additional steps not included in the figure. A process may correspond to a method, function, procedure, subroutine, subprogram, etc. When a process corresponds to a function, its termination may correspond to a return of the function to the calling function or the main function.

Example embodiments of the present disclosure will be described more fully hereinafter with reference to the accompanying drawings in which like numerals represent like elements throughout the several figures, and in which example embodiments are shown. Example embodiments of the claims may, however, be embodied in many different forms and should not be construed as limited to the example embodiments set forth herein. The examples set forth herein are non-limiting examples and are merely examples among other possible examples.

FIG. 1 illustrates a system for adaptive controlling of traffic, according to an example embodiment. The system 100 can comprise various components including but not limited to, a traffic control unit 102 (hereinafter may be referred to as an adaptive traffic controller or simply the traffic controller 102) associated with a smart traffic camera 103 and traffic light 117 installed at an intersection 101. Components of the traffic controller 102 will be further described with reference to FIG. 2. The traffic controller 102 may or may not be physically located near the smart traffic camera 103 or the traffic light 117. There may be more than one smart traffic camera 103 or one traffic light 117 installed at the intersection 101. The smart traffic camera 103 may be one of various types of cameras, including but not limited to, fisheye traffic cameras to detect and optimize traffic flows at the intersection 101 and/or at other intersections part of the same local network or corridor. The smart traffic camera 103 can be any combination of cameras or optical sensors, such as but not limited to, fish-eye cameras, directional cameras, infrared cameras, etc. The smart traffic camera 103 can allow for other types of sensors to be connected to thereto (e.g., via various known or to be developed wired and/or wireless communication schemes) for additional data collection. The smart traffic camera 103 can collect video and other sensor data at the intersection 101 and convey the same to the traffic controller 102 for further processing, as will be described below.

The system 100 may further include cloud network 104, with which traffic controller 102 can communicate using various known or to be developed wired and/or wireless schemes. The cloud network 104 can include components such as a remote traffic data storage (database) 106 and one or more processors 108. The remote traffic data storage 106 can be used to store raw/processed data received from the traffic controller 102 as well as other traffic systems such as the traffic systems 114. The stored data in the remote traffic data storage 106 can be processed/analyzed and modeled (e.g., using various machine learning algorithms) by the processor 108 for example, and used at a later point in time by the traffic controller 102 for adaptive traffic control, as will be described below.

The system 100 can further include central traffic control system 110 accessible by respective/authorized operators via the cloud network 104. As will be described below, the central traffic control system 110 can have a graphical user interface (GUI) 112 associated therewith, which authorized users and operators can log into to gain access to a particular intersection or intersections such as the intersection 101 to designate various zones therein for identifying traffic patterns and applying adaptive traffic control, all of which will be further described below.

While certain components of the system 100 are illustrated in FIG. 1, inventive concepts are not limited thereto and the system 100 may include any number of additional components necessary for operation and functionality thereof.

Other traffic systems may or may not be associated with one or more location intersections/corridor 116 that are near intersection 101. As will be described below, adaptive traffic control schemes adopted by traffic control unit 102 to control traffic at the intersection 101 can be stored/aggregated with other data in the remote traffic data storage 106 and used by other traffic control units at other local intersections 116.

As mentioned above, the components of the system 100 can communicate with one another using any known or to be developed wired and/or wireless network. For example, for wireless communication, techniques such as Visible Light Communication (VLC), Worldwide Interoperability for Microwave Access (WiMAX), Long Term Evolution (LTE), 5G Cellular, Wireless Local Area Network (WLAN), Infrared (IR) communication, Public Switched Telephone Network (PSTN), Radio waves, and other communication techniques known in the art or to be developed may be utilized.

Figure 2:
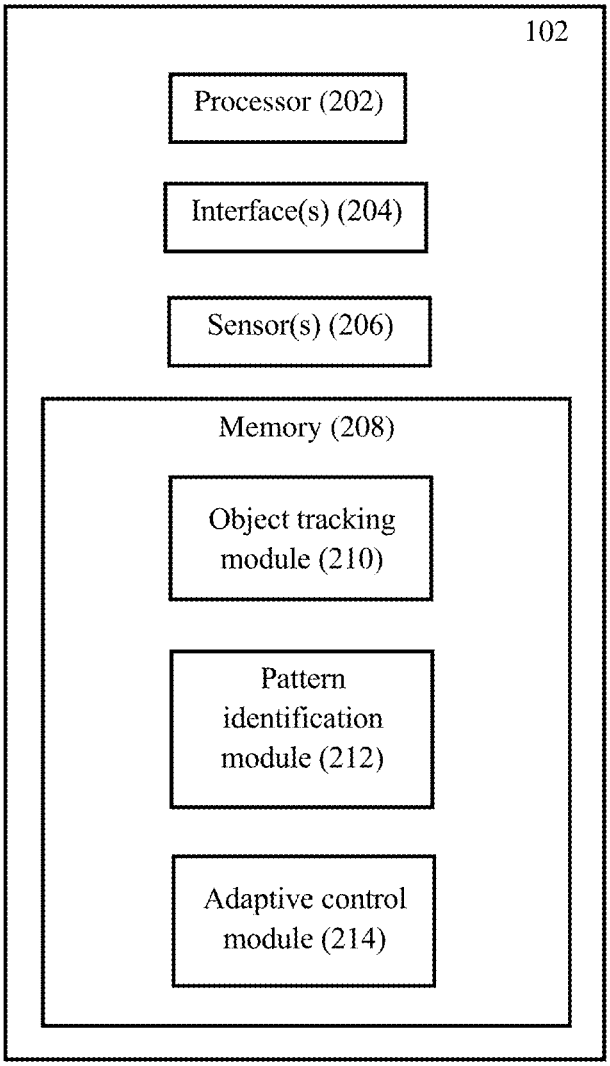
FIG. 2 illustrates a block diagram showing different components of a traffic controller of the system of FIG. 1, according to an example embodiment.

FIG. 2 illustrates a block diagram showing different components of a traffic controller of the system of FIG. 1, according to an example embodiment. As mentioned above, the traffic controller 102 can be physically located near the smart traffic camera 103 and/or the traffic light 117 (e.g., at a corner of the intersection 101) or alternatively can communicate with the smart traffic camera 103 and/or the traffic light 117 wirelessly.

The traffic controller 102 can comprise a processor 202, interface(s) 204, sensor(s) 206, and memory 208. The processor 202 may execute an algorithm stored in the memory 206 for adaptively maintaining control of traffic. The processor 202 may also be configured to decode and execute any instructions received from one or more other electronic devices or server(s). The processor 202 may include one or more general purpose processors (e.g., INTEL® or Advanced Micro Devices® (AMD) microprocessors, ARM) and/or one or more special purpose processors (e.g., digital signal processors, Xilinx® System On Chip (SOC) Field Programmable Gate Array (FPGA) processor, and/or Graphics Processing Units (GPUs)). The processor 202 may be configured to execute one or more computer-readable program instructions, such as program instructions to carry out any of the functions described in this description.

The interface(s) 204 may assist an operator in interacting with the traffic controller 102. The interface(s) 204 of the traffic controller 102 may be used instead of or in addition to the graphical user interface 112 that is centrally accessible by operators. The interface(s) 204 either accept an input from the operator or provide an output to the operator, or may perform both the actions. The interface(s) 204 may either be a Command Line Interface (CLI), Graphical User Interface (GUI), voice interface, and/or any other user interface known in the art or to be developed.

The sensor(s) 206 can be one or more smart cameras such as fish-eye cameras mentioned above or any other type of sensor/capturing device that can capture various types of data regarding activities at the intersection 101. Sensor(s) 206 may be the same as smart traffic camera 103. Any one such sensor 206 can be located at the intersection 101 and coupled to the traffic controller 102 and/or the traffic light 117.

In one example embodiment, the traffic light 117 associated with the traffic controller 102 can have different traffic signals directed towards all the roads leading to the intersection 101. The different signals may comprise a Red light, Yellow light, and a Green light. As mentioned, the sensor(s) 206 may be installed to capture objects moving across the roads. The sensor(s) 206 used may include, but are not limited to, optical sensors such as fish-eye camera mentioned above, Closed Circuit Television (CCTV) camera, and Infrared camera. Further, sensor(s) 205 can include, but not limited to induction loops, Light Detection and Ranging (LIDAR), radar/microwave, weather sensors, motion sensors, audio sensors, pneumatic road tubes, magnetic sensors, piezoelectric cable, and weigh-in motion sensor, which may also be used in combination with the optical sensor(s) or alone.

The memory 208 may include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions.

The memory 208 may comprise modules implemented as a program and executed by the processor 202. In one case, the memory 208 may comprise an object tracking module 210, a pattern identification module 212, and an adaptive control module 214. All such modules may be executed by the processor 202.

Operations performed by the traffic controller 102 to enable adaptive control of traffic conditions at the example intersection 101 will be further described below with reference to accompanying figures. While in FIG. 1 and throughout the present disclosure reference is made to traffic controller 102 being located in geographical proximity of the intersection 101, inventive concepts are not limited thereto. For example, traffic controller 102 may be a cloud based network component and/or may be embedded within the central traffic control system 110.

While certain components of the traffic controller 102 are illustrated in FIG. 2 and described above, components of the traffic controller 102 are not limited to those shown in FIG. 2. The traffic controller 102 can include more or less components (e.g., transceivers, network interfaces, etc.) as may be necessary for routine and full operation thereof.

As mentioned with reference to FIG. 1, the system 100 also includes a centralized traffic control system 110 accessible via the graphical user interface 112. This graphical user interface 112 allows local officials and operators (upon entering login information and being authorized in response thereto) to access any particular intersection, view live conditions thereof, modify traffic control variables, define new control variables, change data collection settings, perform adaptive traffic control for these intersections, etc. However, before any adaptive traffic control can be implemented at any given intersection, the network operator may designate various zones (e.g., ingress/exit zones, detection zones, etc.), which can provide a structure for how the live traffic will be monitored such that corresponding data is collected for use by the traffic controller 102 to implement adaptive traffic control at that intersection. Therefore, prior to describing the functionalities and operations of the traffic controller 102, an example graphical user interface 112 and use thereof in specifying zones at the intersection 101 will be described with reference to FIG. 3.

Figure 3:
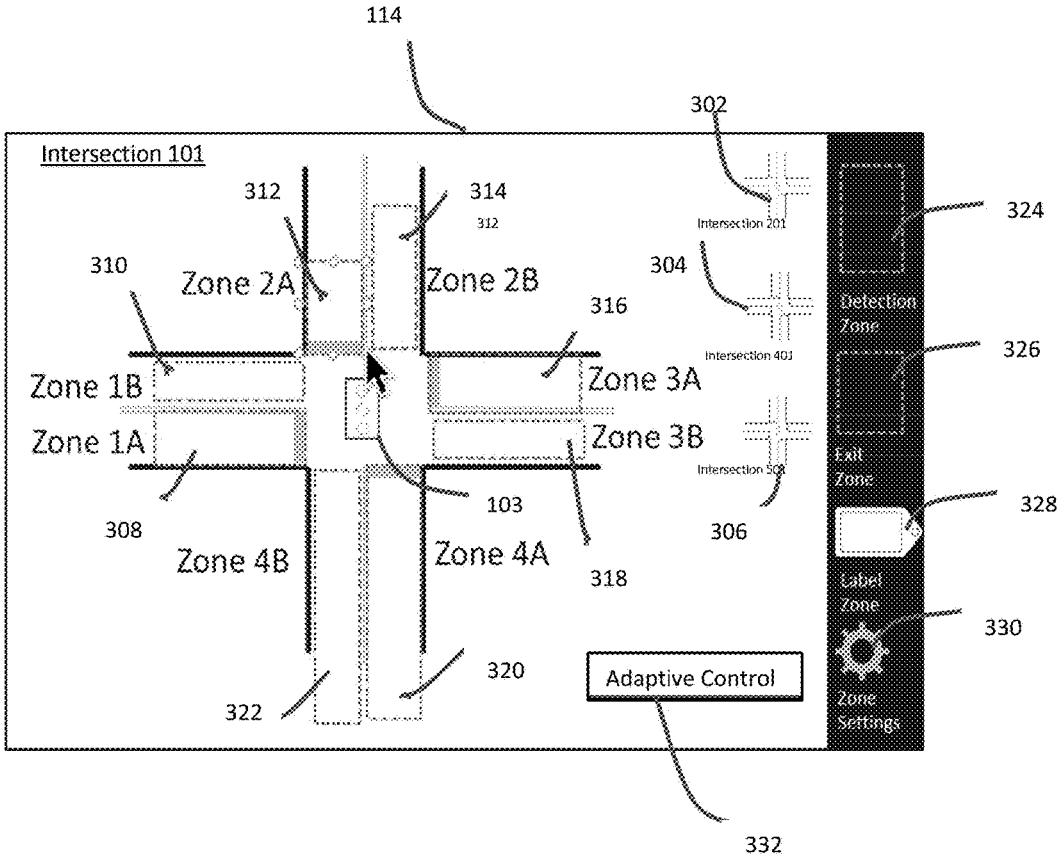
FIG. 3 illustrates a Graphical User Interface (GUI) for allowing an operator to define detection zones in an intersection, for detecting objects entering, objects exiting, and objects approaching the intersection, according to an example embodiment.

FIG. 3 illustrates a Graphical User Interface (GUI) for allowing an operator to define detection zones in an intersection, for detecting objects entering, objects exiting, and objects approaching the intersection, according to an example embodiment.

In one example embodiment, the GUI 112 may allow the operator to define detection zones for the intersection 101. Using the GUI 112, the operator may select one intersection amongst many intersections of other roads. The GUI 112 may receive live sensor data from sensor(s) 206 installed with the traffic controller 102 of the selected intersection 101.

In one example, the operator may select 'Intersection 101' as shown in FIG. 3, which may be the same as intersection 101 in FIG. 1. GUI 112 can also include "thumbnails" of other nearby intersections such as thumbnails 302, 304 and 306 representing nearby intersections 201, 401 and 501 respectively.

Upon selecting the 'Intersection 101' and receiving video image from sensors 206 corresponding to the intersection 101, the operator may draw and label detection zones for detecting and tracking traffic at 'Intersection 101.' For example, as shown in FIG. 3, the operator may label each side of intersection 101 (each road leading to the intersection 101) with one or more zones such as detection zone 1A 308, exit zone 1B 310, detection zone 2A 312, exit zone 2B 314, detection zone 3A 316, exit zone 3B 318, detection zone 4A 320 and exit zone 4B 322. The labeling may be made using via label zone button (tool) 328. Marks 324 and 326 can be identifiers for distinguishing detection zones from exit zones, respectively. The use of detection zones and exit zones will be further described below with reference to FIGS. 4 and 5.

The operator may also be able to customize settings of the selected zone, using a 'zone settings' tab 330. In one example, the operator may modify default control settings for each zone, such as, but not limited to, changing default phase times for each zone and changing phase times based on traffic. The operator may also enable or disable adaptive controls using button 332 on the GUI 112.

With an operator having specified traffic control variables, various zones and adaptive traffic control at the intersection 101, we now turn to the operation of traffic controller 102 for adaptively controlling the traffic at the intersection 101.

Figure 4:
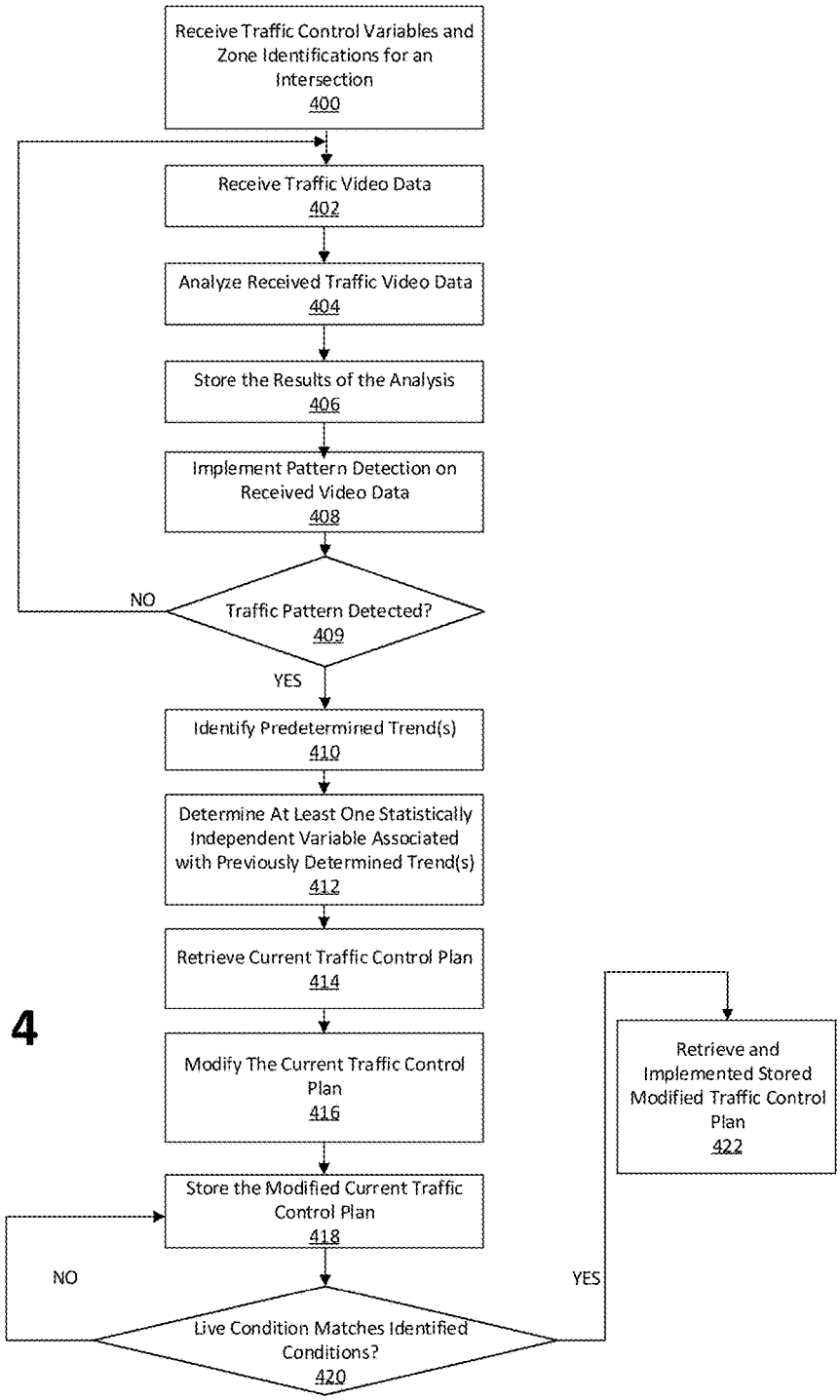
FIG. 4 illustrates a method of adaptive controlling of traffic, according to an example embodiment.

FIG. 4 is a method of adaptive controlling of traffic, according to an example embodiment. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed example embodiments.

Furthermore, FIG. 4 will be described from the perspective of the traffic controller 102. However, those having ordinary skill in the art would readily appreciate that the functionalities described with reference to FIG. 4 are carried out when the processor 202 of the traffic controller 102 executes one or more computer-readable instructions/programs/modules (e.g., object tracking module 210, pattern identification module 212 and adaptive control module 214) stored on the memory 208. Furthermore, FIG. 4 will be described with reference to FIGS. 1-3.

At step 400, the traffic controller 102 may receive traffic control variables and zone designations for the intersection 101 from the central traffic control system 110. As described above, these traffic control variables and zones may have been specified/designated by an operator via the GUI 112 (or alternatively using "local" interface(s) 204 of the traffic controller 102).

At step 402, the traffic controller 102 may receive video data of traffic at the intersection 101 from the sensor(s) 206, such as one or more fish-eye cameras installed at the intersection 101. The sensor(s) 206 may continuously capture and send traffic video data to the traffic controller 102 or alternative to the remote data traffic data storage 106 on the cloud network 104 for retrieval by the traffic controller 102 at a later point in time.

At step 404, the traffic controller 102 may implement the object tracking instructions 210 stored on the memory 208 to analyze the received video data of the intersection 101 and detect number of vehicles traveling through the intersection 101. In one example, the traffic controller 102 uses the designated zones received at step 400 to track each vehicle as it moves through the intersection 101. For example, the traffic controller 102 tracks every vehicle that enters and exits the intersection 101 as well as the number of vehicles in a given detection zone (e.g., detection zone 1A 308). Vehicles are detected and tracked by the traffic controller 102 using any known or to be developed object detection and tracking methods.

For example, once the traffic signal 117 changes (e.g., from red to green), the vehicles in the detection zone 1A 308 start moving and the object tracking methods follow the movement of the vehicles through the intersection 101 and to one of the exit zones (e.g., the exit zone 3B 318).

In one example, the traffic controller 102 tracks the number of objects (vehicles, bikes, pedestrians, etc.) moving through the intersection 101 for a period of time (e.g., 1 minute, 5 minutes, 1 hour, 24 hours, a week, etc.) to determine a rate of change in the observed traffic at the intersection 101.

At step 406, the traffic controller 102 may store the results of the above analysis (detection of movements of the vehicles). The results stored can include, but is not limited to, a number of vehicles detected, the corresponding detection and/or exit zones, time of day at which the vehicles were detected, weather conditions, the rate of change, etc. The traffic controller 102 may store the results in the remote traffic data storage 106.

In one example, the traffic controller 102 may perform steps 404 and 406 for every designated zone at the intersection 101, as traffic image/video data are received from the sensor(s) 206. If data is continuously received from the sensor(s) 206, then the traffic controller 102 performs steps 404 and 406 continuously.

At step 408, the traffic controller 102 may implement the pattern identification program/module 212 stored on the memory 208 to determine a traffic pattern. For example, the traffic controller 102 analyzes the data gathered at step 404 and stored at step 406 to determine a statistical correlation between at least two variables (e.g., a time of day, a day of the week, a scheduled event, etc., with the number of vehicles detected traveling through the intersection at step 404). In one example, the traffic controller 102 may determine a 600% increase in a number of cars at the intersection 101 at 6 PM relative to 5:45 PM. In one example, such pattern can be for the entire intersection 101 or a particular zone (or two or more zones) thereof, as identified per step 400.

At step 409, the traffic controller 102 may determine if a traffic pattern is identified at the intersection 101 at step 408.

If at step 409, a traffic pattern is not identified, then the process reverts back to step 402. In one example, instead of receiving traffic data from the sensor(s) 206 upon returning to step 402, the traffic controller 102 may retrieve the data from the remote database 106.

However, if at step 409, the traffic controller 102 determines that a traffic pattern is identified, then the process proceeds to step 410 as will be described below.

At step 410, the traffic controller may identify one or more previously defined (predetermined) trends in traffic pattern. For example, a predetermined pattern may be a linear rate greater than 5 times (>5×) the rate of the number of objects (e.g., vehicles) passing per minute, through the intersection 101. Another predetermined pattern may be a pattern linked historically with growing traffic. For example, the rate of increase in the number of objects rises for a certain amount of time, stays constant for a certain amount of time, and rises again at a certain pace. Another predetermined pattern may be a deep dive in the rate of the number of objects such as 10 times (10×), suggesting perhaps an accident upstream relative to a given direction from the intersection 101. Such a predetermined pattern may lead to a change in traffic control. Yet another predetermined pattern may be related to a localized event, such as concert ending causing many patrons to leave from a single location and creating a delay between two increased rates, i.e., a first rate for early patrons leaving and a second rate for the major patrons leaving the concert. Yet another predetermined pattern may be traffic released from a faulty previous traffic signal indicator. In one example, the traffic patterns may be stored in and retrieved from the Remote Traffic Data Storage 106 on the cloud network 104.

At step 412, the traffic controller 102 may determine at least one statistically independent variable associated with the one or more predetermined trends identified at step 410. Examples of statistically independent variables include, but are not limited to, a time of day, a day of the week, weather conditions, etc.

For example, at step 412, the traffic controller 102 may determine that the predetermined trend of rate of increase of traffic that are greater than 5 times the average number of vehicles passing through the intersection 101, are correlated with statistically independent variable of time of day.

Figure 5:
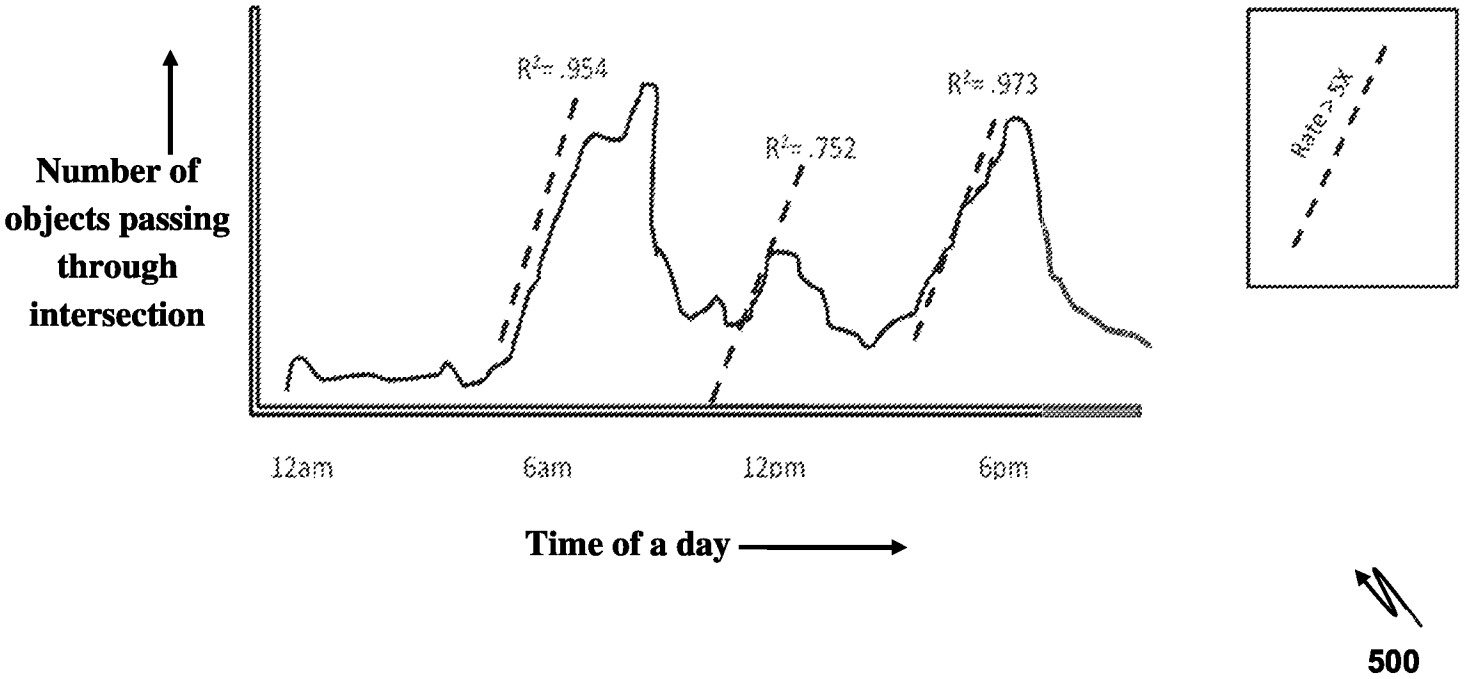
FIG. 5 illustrates a correlation map between 'number of objects passing through intersection' and 'time of day,' according to an example embodiment.

In one example embodiment, this determination between at least one statistically independent variable and previously determined trends may be based on the analysis of a correlation map. FIG. 5 illustrates an example correlation map between the 'number of objects passing through the intersection' and 'time of a day,' according to an example embodiment. The correlation map 500 is shown for the traffic flowing from one zone (e.g., the zone 1A 308) to another zone (e.g., the zone 3B 318).

As seen in the FIG. 5, the correlation map 500 shows a sharp increase in traffic during three times of a day i.e. 6 A.M., 12 P.M., and 5 P.M. During such instances, the coefficient of determination is found to be 0.945, 0.752, and 0.973 respectively. In one example, when a coefficient of determination between two variables is greater than a threshold (e.g., greater than 0.5, 0.6, 0.7, 0.8, 0.9, etc.), a statistical correlation between the two variable is determined. The threshold can be a configurable parameter determined based on experiments and/or empirical studies.

According to the example correlation map 500, the traffic controller 102 determines a statistical correlation between the time(s) on a given day (statistically independent variable, which may also be referred to as the identified condition or variable) and an increase of at least 5 times (predetermined trend) in the traffic rate at the intersection 101.

Once a correlation between at least one statistically independent variable (e.g., time of day) and a rate of increase of at least 5 times is established by the traffic controller at step 412, the traffic controller 102 determines that adaptive controlling of traffic at the intersection 101 is to be implemented because the traffic controller 102 can now confirm that the traffic pattern detected at step 406 (e.g., 600% increase in number of vehicles (rate of traffic)) at the intersection 101 is correlated with the corresponding 6 PM timestamp.

Thereafter, at step 414, the traffic controller 102 may retrieve a currently implemented traffic control program at the intersection 101. For example, the currently implemented traffic control program can be green light for 115 seconds, yellow light for 5 seconds and red light for 360 seconds. This may be retrieved from the remote traffic data storage 106

At step 416, which may be performed simultaneously with step 414 or prior thereto, the traffic controller 102 may modify the currently implemented traffic control program. For example, the traffic controller 102 may increase the duration of green for the traffic light 117 by 50% (for particular zone(s) associated with the detected traffic pattern) while reducing the duration of red light by 50%.

In one example embodiment, the proportions with which durations of different lights (green, red and yellow) are modified at steps 416 may be directly based on the rate of increase in traffic (1 to 1 ratio), may be multiplied by a factor, be related thereto on a logarithmic scale, etc.

At step 418, the traffic controller 102 may store the modified traffic control program of step 416 in the remote traffic data storage 106.

Thereafter, at step 420, the traffic controller 102 may continuously monitor live traffic conditions at the intersection 101 (via live feeds received from the sensor(s) 206) to detect a condition which triggers the modified traffic control program of step 416. For example, via one or more docks, the traffic controller 102 can detect, during a following day, that it is 6 PM. In other words, at step 420, the traffic controller determines if a live condition at the intersection 101 matches one or more identified variables or conditions of step 412. Step 420 is continuously performed until a match is detected.

Thereafter, at step 422 and upon detecting the match, the traffic controller 102 retrieves the modified traffic control program stored at step 418 and implements the same to adjust the traffic lights at the intersection 101.

After step 422, the process ends and returns to step 400.

Example embodiments described above have generally focused on detecting traffic patterns at a single intersection and modifying traffic control programs based thereon. However, inventive concepts are not limited thereto.

For example, several intersections (e.g., intersections 116) of FIG. 1 that are in the same corridor or in vicinity of one another may coordinate among themselves in detecting patterns and ultimately perform adaptive traffic control. Detected patterns, traffic trends, variables and conditions for each nearby intersection may be stored in the remote traffic data storage 116. When, at any given time, one or more traffic controllers at individual intersections are determining patterns, statistically independent variables and prior trend(s) associated with such variables, the traffic controllers not only look at data from that particular intersection but also take into consideration traffic patterns at other nearby intersection in determining the extent of adjust to currently implemented traffic control programs.

Furthermore, upon modifying a particular traffic control program at a corresponding intersection, as described above, the respective traffic controller may also monitor how the change in the traffic control program affects traffic (e.g., by receiving live traffic data from sensors at other nearby intersections) at other nearby intersections and may perform further adaptive control to adjust for any effect observed (adverse or not) at the other nearby intersections due to the modified traffic control program.

Example embodiments of the present disclosure may be provided as a computer program product, which may include a computer-readable medium tangibly embodying thereon instructions, which may be used to program a computer (or other electronic devices) to perform a process. The computer-readable medium may include, but is not limited to, fixed (hard) drives, optical disks, compact disc read-only memories (CD-ROMs), and magneto-optical disks, semiconductor memories, such as ROMs, random access memories (RAMs), programmable read-only memories (PROMs), erasable PROMs (EPROMs), electrically erasable PROMs (EEPROMs), flash memory, magnetic or optical cards, or other type of media/machine-readable medium suitable for storing electronic instructions (e.g., computer programming code, such as software or firmware).

Moreover, example embodiments of the present disclosure may also be downloaded as one or more computer program products, wherein the program may be transferred from a remote computer to a requesting computer by way of data signals embodied in a carrier wave or other propagation medium via a communication link (e.g., a modem or network connection).

What is claimed is:

1. A method of controlling traffic at an intersection comprising:

receiving traffic data from one or more sensors at the intersection, wherein the traffic data comprises data regarding objects at the intersection detected by the one or more sensors;

detecting, using the traffic data for a period of time, a pattern of movement of the objects on at least two roads of the intersection during the period of time, wherein detecting the pattern comprises:

analyzing the traffic data to determine a number of the objects at the intersection during the period of time; and detecting the pattern by determining a rate of change in the number of the objects relative to at least one variable;

determining if the pattern is associated with one or more predetermined traffic patterns at the intersection;

based on the determining, retrieving a current traffic control program implemented at the intersection;

controlling the traffic at the intersection by adjusting one or more parameters of the current traffic control program to yield a modified traffic control program, wherein the adjusting is based on the one or more predetermined traffic patterns; and storing the modified traffic control program in a database for future use.

2. The method of claim 1, wherein the number of the objects is determined using identified zones at the intersection.

3. The method of claim 2, further comprising:

receiving identifications of the zones at the intersection via a graphical user interface.

4. The method of claim 1, further comprising identifying at least one statistically independent variable in the pattern.

5. The method of claim 4, wherein the at least one statistically independent variable is one or more of a time of day, a day of a week, weather conditions at or near the intersection or at least one scheduled event at or near the intersection.

6. The method of claim 1, wherein adjusting the one or more parameters is proportional to a rate of change in objects detected in the pattern.

7. The method of claim 1, further comprising:

monitoring live conditions at the intersection;

determining if at least one live condition matches at least one variable of the detected pattern; and applying the modified traffic control program to the intersection when the at least one live condition matches the at least one variable.

8. A traffic controller comprising:

memory having computer-readable instructions stored therein; and one or more processors configured to execute the computer-readable instructions to:

receive traffic data from one or more sensors at an intersection, wherein the traffic data comprises data regarding objects at the intersection detected by the one or more sensors;

detect, using the traffic data for a period of time, a pattern of movement of the objects on at least two roads of the intersection during the period of time, wherein the one or more processors are configured to execute the computer-readable instructions to detect the pattern by:

analyzing the traffic data to determine a number of the objects at the intersection during the period of time; and detecting the pattern by determining a rate of change in the number of the objects relative to at least one variable;

determine if the pattern is associated with one or more predetermined traffic patterns at the intersection;

based on the determining, retrieve a current traffic control program implemented at the intersection;

control traffic at the intersection by adjusting one or more parameters of the current traffic control program to yield a modified traffic control program, wherein the adjusting is based on the one or more predetermined traffic patterns; and store the modified traffic control program in a database for future use.

9. The traffic controller of claim 7, wherein the one or more processors are further configured to execute the computer-readable instructions to identify at least one statistically independent variable in the pattern.

10. The traffic controller of claim 9, wherein the at least one statistically independent variable is one or more of a time of day, a day of a week, weather conditions at or near the intersection or at least one scheduled event at or near the intersection.

11. The traffic controller of claim 7, wherein the database is communicatively coupled to the traffic controller.

12. The traffic controller of claim 7, wherein the one or more sensors are one or more of a fish-eye camera, an infrared camera, a motion sensor, or an audio sensor.

13. The traffic controller of claim 7, wherein the one or more processors are configured to execute the computer-readable instructions to:

send the modified traffic control program to at least one smart traffic light installed at the intersection for implementation.

14. One or more non-transitory computer-readable medium having computer-readable instructions stored thereon, which when executed by one or more processors, cause the one or more processors to:

receive traffic data from one or more sensors at an intersection, wherein the traffic data comprises data regarding objects at the intersection detected by the one or more sensors;

detect, using the traffic data for a period of time, a pattern of movement of the objects on at least two roads of the intersection during the period of time, wherein the execution of the computer-readable instructions by the one or more processors, further cause the one or more processors to detect the pattern by:

analyzing the traffic data to determine a number of the objects at the intersection during the period of time; and detecting the pattern by determining a rate of change in the number of the objects relative to at least one variable;

determine if the pattern is associated with one or more predetermined traffic patterns at the intersection;

based on the determining, retrieve a current traffic control program implemented at the intersection;

control traffic at the intersection by adjusting one or more parameters of the current traffic control program to yield a modified traffic control program, wherein the adjusting is based on the one or more predetermined traffic patterns; and store the modified traffic control program in a database for future use.

15. The one or more non-transitory computer-readable medium of claim 14, wherein the execution of the computer-readable instructions by the one or more processors, cause the one or more processors to identify at least one statistically independent variable in the pattern.

16. The one or more non-transitory computer-readable medium of claim 15, wherein the at least one statistically independent variable is one or more of a time of day, a day of a week, weather conditions at or near the intersection or at least one scheduled event at or near the intersection.

17. The one or more non-transitory computer-readable medium of claim 14, wherein the execution of the computer-readable instructions by the one or more processors, cause the one or more processors to further detect the pattern by:

monitoring live conditions at the intersection;

determining if at least one live condition matches at least one variable of the detected pattern; and applying the modified traffic control program to the intersection when the at least one live condition matches the at least one variable.

* * * * *